US005174619A

United States Patent [19]

Bender et al.

[11] Patent Number: 5,174,619

[45] Date of Patent: Dec. 29, 1992

[54] TAILGATE HANDLE ASSEMBLY WITH SLIDING AND PIVOTING LEVER

[76] Inventors: Frederick F. Bender, 9765 Daleview Dr., South Lyon, Mich. 48178; Earl L. Watson, 2560 Canal, Walled Lake, Mich. 48390

[21] Appl. No.: 797,562

[22] Filed: Nov. 25, 1991

[51] Int. Cl.[5] ..... F05B 7/00

[52] U.S. Cl. ..... 292/336.3; 70/279; 70/DIG. 27

[58] Field of Search ..... 70/218, 279; 292/336.3, 292/DIG. 43, DIG. 31, DIG. 27, DIG. 23

[56] References Cited

U.S. PATENT DOCUMENTS

| | | | |
|---|---|---|---|
| 1,964,066 | 6/1934 | Kuszmaul | 292/DIG. 27 |
| 2,333,861 | 11/1943 | Harden | 70/218 |
| 2,603,963 | 7/1952 | Allen | 292/DIG. 27 |
| 2,608,428 | 8/1952 | Allen | 292/DIG. 27 |
| 2,916,903 | 12/1959 | Squire | 70/218 |
| 3,309,127 | 3/1967 | Pickles | 292/DIG. 27 |
| 4,616,862 | 10/1986 | Ward | 292/DIG. 27 |
| 4,778,207 | 10/1988 | Gergoe | 292/DIG. 31 |
| 4,834,433 | 5/1989 | Keller | 292/DIG. 31 |

FOREIGN PATENT DOCUMENTS

| | | | |
|---|---|---|---|
| 685943 | 12/1939 | Fed. Rep. of Germany | 70/218 |
| 5427 | of 1911 | United Kingdom | 292/DIG. 27 |
| 232079 | 4/1925 | United Kingdom | 292/DIG. 27 |
| 612984 | 11/1948 | United Kingdom | 292/DIG. 27 |

*Primary Examiner*—Eric K. Nicholson
*Attorney, Agent, or Firm*—Edward P. Barthel

[57] ABSTRACT

A tailgate handle assembly in a housing including a flush-mounted handle and an adjacent key cylinder. The housing is spaced apart from a latch mechanism. A laterally extending lever is slidably actuated on the housing from a locked mode to an unlocked mode manually by rotation of the key cylinder, or electrically via a power actuator, and then pivoted by manual lift-pulling on the handle, to thereby lift a latch rod extending between the lever and the latch mechanism to actuate the latter.

11 Claims, 3 Drawing Sheets

TAILGATE HANDLE ASSEMBLY WITH SLIDING AND PIVOTING LEVER

TECHNICAL FIELD

This invention relates generally to tailgate lock mechanisms and, more particularly, to a handle assembly therefor.

BACKGROUND ART

Childs et al U.S. Pat. No. 4,969,672 and Lira U.S. Pat. No. 4,155,233 disclose deck lid release mechanisms wherein the key cylinder and actuator apparatus are located with the latch near the bottom of the deck lid.

Pastva, Jr. et al U.S. Pat. No. 4,312,202 and Pelcin U.S. Pat. No. 4,321,812 each disclose a key cylinder and a handle in the same housing with a latching bolt.

Bertolini U.S. Pat. No. 4,898,413 discloses a handle pivotally mounted in a recess in a front plate. Manual movement of the handle operates through oppositely disposed pairs of links to pivot a laterally extending lever about an intermediate pin, with an end of the lever adapted to actuate latch opening linkage.

DISCLOSURE OF THE INVENTION

A general object of the invention is to provide an improved tailgate handle assembly.

Another object of the invention is to provide an improved tailgate handle assembly as part of a tailgate latching system with a minimum number of components.

A further object of the invention is to provide a tailgate handle assembly wherein the key cylinder and handle are mounted in a housing which is mounted on the tailgate spaced upwardly from the usual latch mechanism.

Still another object of the invention is to provide a tailgate key cylinder and handle assembly including a laterally extending lever which is slidably actuated from a locked mode to an unlocked mode by manual rotation of the key cylinder or by power actuation, and then pivoted by manual lift-pulling on the handle, to thereby lift a latch rod secured at the upper end thereof to the lever and at the lower end thereof to a latch mechanism.

These and other objects and advantages of the invention will become more apparent when reference is made to the following drawings and the accompanying description.

BRIEF DESCRIPTION OF THE DRAWINGS

FIG. 8 is an enlarged view of a portion of the FIGS. 3–5 structure illustrating three operational positions thereof.

BEST MODE OF CARRYING OUT THE INVENTION

Figure 1:
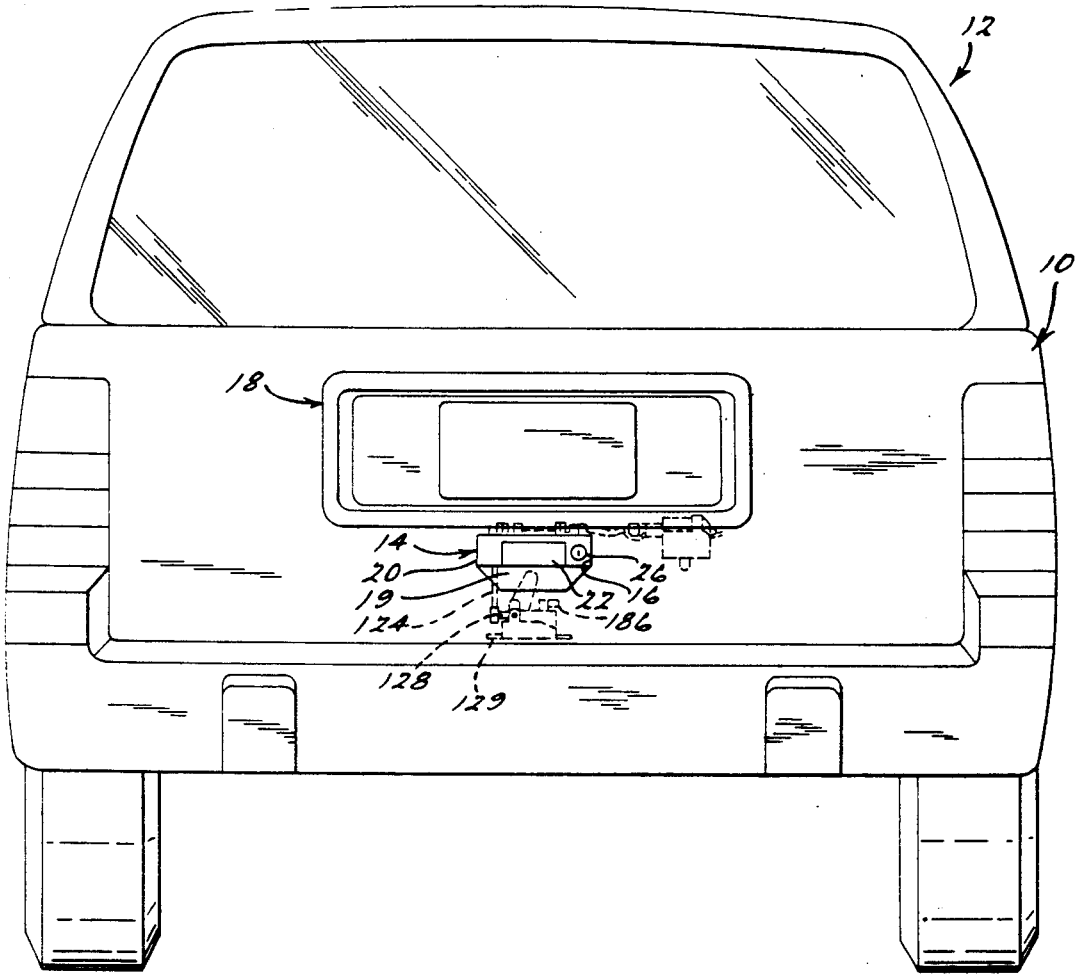
FIG. 1 is a rear view of a vehicle illustrating its tailgate and a tailgate housing assembly embodying the invention.

Referring now to the drawings in greater detail, FIG. 1 illustrates a tailgate 10 of a vehicle 12. A liftgate outside handle assembly 14 is mounted in an opening 16 formed in a central portion of the tailgate 10, just below the usual license plate mounting frame 18 formed in the tailgate and above a recess 19 formed therein. As such the assembly 14 is positioned as high as possible above the lower end of the tailgate 10, away from any water and contaminants that may be lifted up from the roadway.

The handle assembly 14 includes a housing 20 having a flush-type, pull-to handle 22 pivotally mounted in a central pocket 24 in the housing, as will be explained, and a key cylinder 26 rotatably mounted in one end of the housing.

Figure 7:
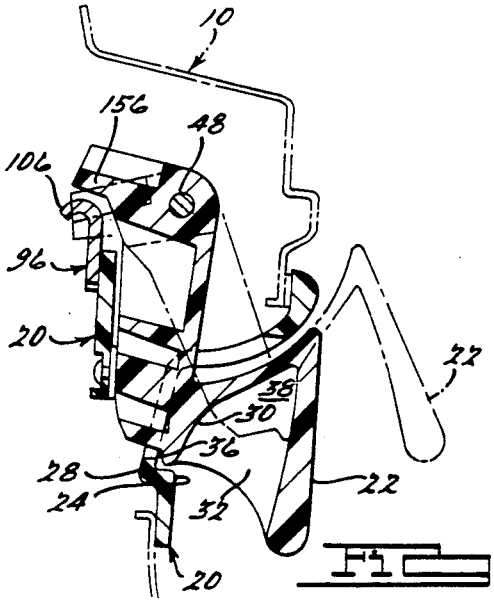
FIG. 7 is a cross-sectional view taken along the plain of the line 7—7 of FIG. 4, and looking in the direction of the arrows, and illustrating two operational positions of a portion of the invention.
Figures 2, 3, 9:
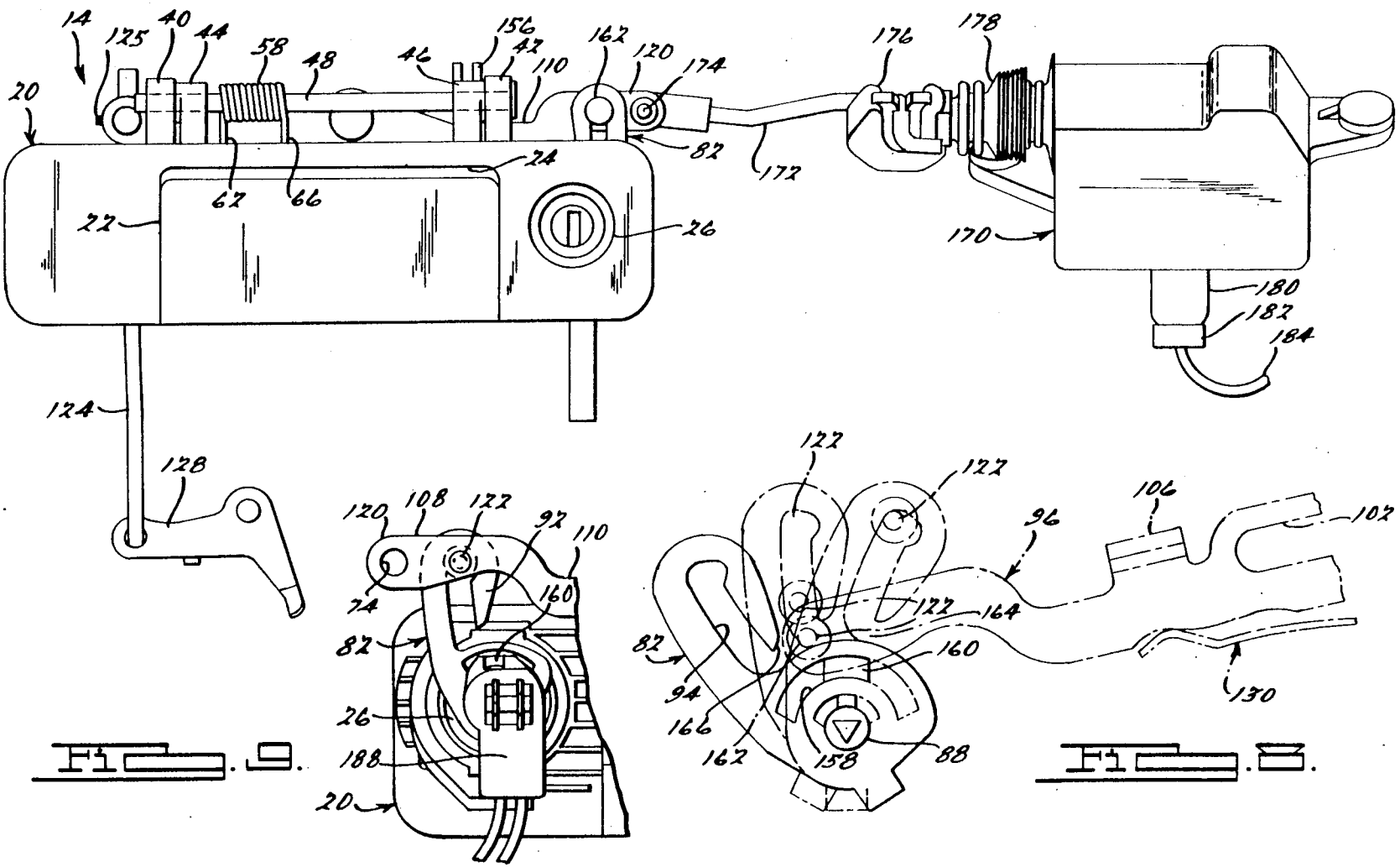
FIG. 2 is a front view of the inventive housing assembly, and remote mounted latch and power actuator therefor.
FIG. 3–5 are rear views of the housing assembly of FIG. 2 illustrating three operational conditions thereof.
FIG. 9 is a fragmentary view of a portion of the FIG. 4 structure illustrating the inclusion of an additional component mounted thereon.
Figure 3:
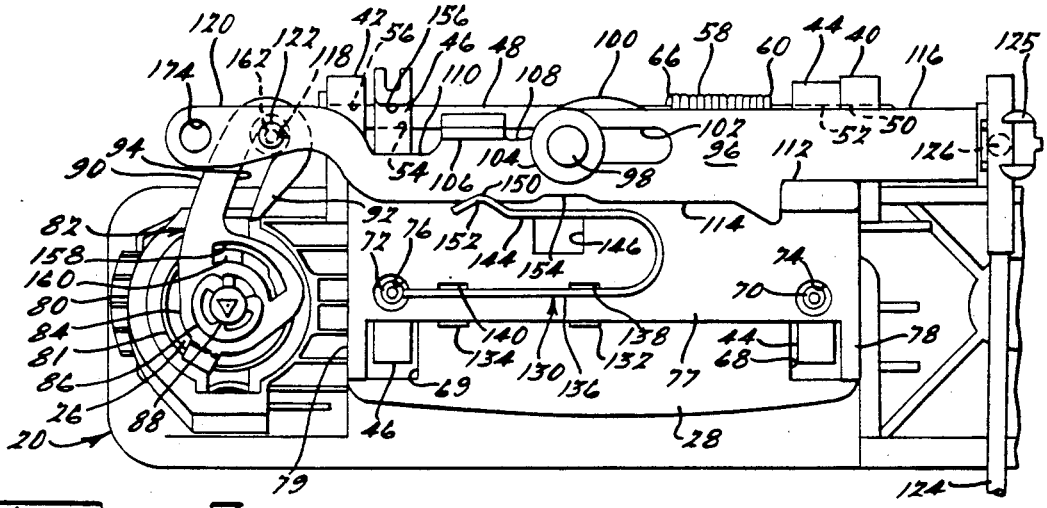
Figure 4:
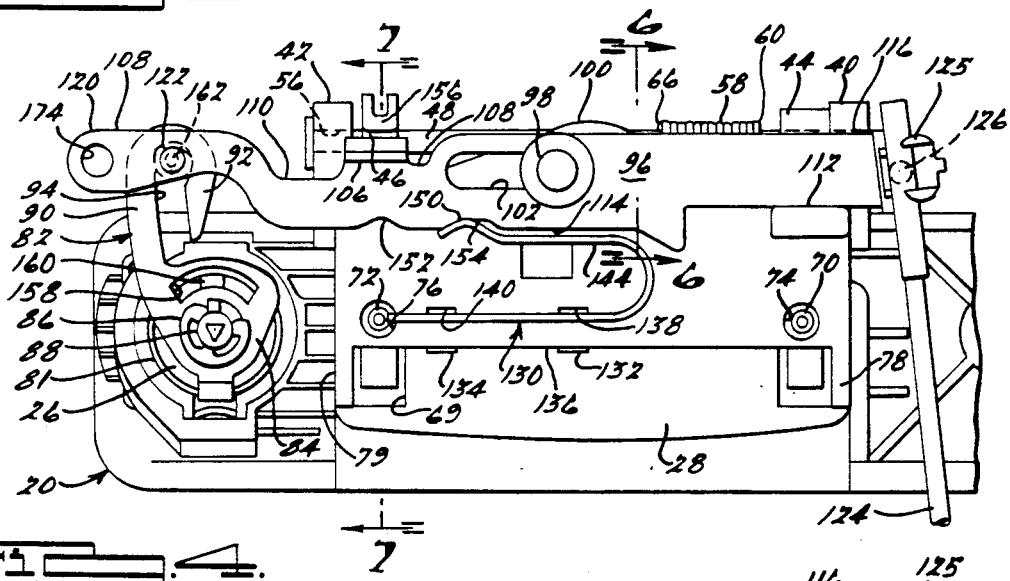
Figure 5:
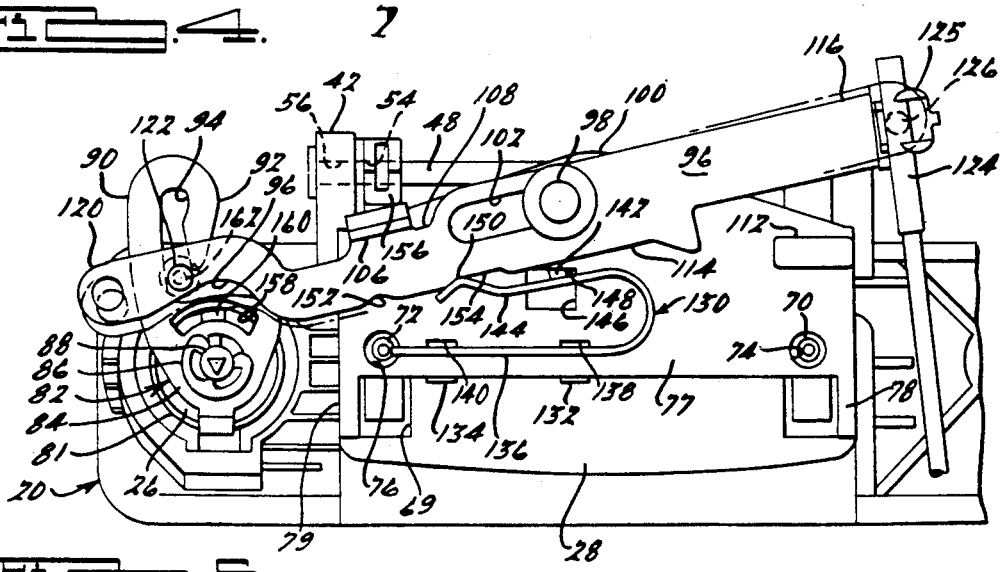

As shown in FIG. 3–5, an arcuate-shaped wall 28 forms the back of the pocket 24. Similarly, an arcuate-shaped back wall 30 (FIG. 7), connected by short side walls 32 to the handle 22, abuts against a recessed surface 36 formed in the wall 28. The walls 30, 32 and 34 form a pocket 38 behind the handle 22 for the insertion therein of an operator's fingers above the recess 19.

Figure 6:
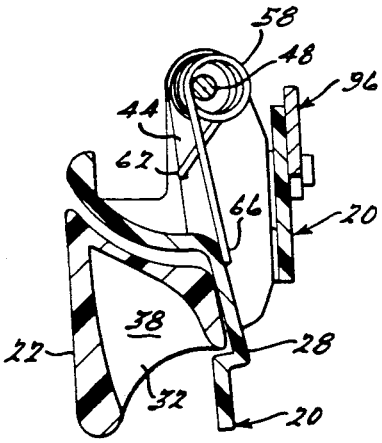
FIG. 6 is a cross-sectional view taken along the plain of the line 6—6 of FIG. 4, and looking in the direction of the arrows.

Referring now to FIGS. 3–5, it is noted that two spaced-apart, upwardly extending mounting flanges 40 and 42 are formed on the back side of the housing wall 28. A pair of upwardly extending mounting arms 44 and 46 are formed on the back side of the handle wall 30, adapted to extend upwardly adjacent the inside surfaces of the respective mounting flanges 40 and 42. A pivot pin 48 extends through aligned openings 50, 52, 54, and 56 formed adjacent the upper ends of the respective mounting members 40, 44, 42, and 46, such that the mounting arms 44 and 46 are pivotally mounted thereon, to accommodate the manual lifting of the handle 22. A coil spring 58 is mounted around the end portion of the pin 48 adjacent the mounting arm 44. An end wire 60 extending from one end of the spring 58 extends downwardly along side the arm 44, with a bent end 62 (FIG. 6) thereof extending laterally so as to lie on the front edge 64 of the arm 44. A second end wire 66 extending from the other end of the spring 58 extends downwardly so as to engage the back side of the wall 28 forming the pocket 24 in the housing 20. As such, the coil spring 58 and its ends 62 and 66 serves to urge the handle 22 into its closed, flush position in the housing 20.

As shown in FIG. 3, the upwardly extending mounting arms 44 and 46 extend through respective openings 68 and 69 formed in the back wall 28 of the housing pocket 24. When the back wall 30 of the handle 22 is urged by the spring 58 into the recessed surface 36 of the housing wall 28, the arms 44 and 46 abut against respective rubber stops 70 and 72 mounted in holes 74 and 76 formed in an additional back wall 77 having side walls 78 and 79 molded between the housing upwardly extending mounting flanges 40 and 42.

Referring further to FIG. 3, it is noted that the key cylinder 26 is inserted into and rotatably mounted in an enclosure 80 molded as an integral part of the back of the housing 20 adjacent a side of the pocket 24. A coil spring, represented as 81, is mounted around the cylinder 26 exterior of the enclosure 80, serving to return the cylinder to center after a key (not shown) has rotated the cylinder.

A hook-like key cylinder lever 82 is secured at its lower body portion 84 by a suitable fastener 86 to an extension 88 of the key cylinder 26. An upwardly extending arm 90 is formed on the lower end portion 84, and a downwardly extending finger 92 is formed on the arm 90, such that an open-ended slot 94 is formed between the arm 90 and the finger 92 for a purpose to be described.

A main lever 96 is laterally slidably mounted on the upper portion of the back side of the back wall 77. Specifically, a pin 98 is mounted through an upwardly tapered extension 100 of the back wall 77, and a slot 102 is formed in a mid-section of the lever 96 for mounting on the pin 98. A washer 104 retains the lever 96 on the pin 98.

A bent-over lip 106 is formed on a top edge 108 of the lever 96 adjacent one end of the slot 102. A groove 110 is formed in the top edge 108 adjacent the lip 106. An abutment 112 is formed on the back wall 77 for cooperation with a bottom edge 114 of the lever 96 midway between the slot 102 and the end 116 of the lever on the side thereof opposite the lip 106.

An opening 118 is formed adjacent the other end 120 of the lever 96. A pin 122 is mounted through the opening 118 intermediate the end 120 and the groove 110 thereof. The pin 122 extends through the slot open-ended 94 of the key cylinder lever 82 at the juncture of the arm 90 and the finger 92. A contour 123 is formed adjacent the juncture to prevent the pin 122 from binding in the slot 94.

A latch release rod 124 is secured at its upper end to a connector clip 125 which is pivotally mounted in an opening 126 formed adjacent the end 116 of the lever 96. The rod 124 extends downwardly so as to be operatively connected to a latch lever 128 (FIG. 2) extending from a latch mechanism 129 in FIG. 1, located adjacent the bottom edge of the tailgate 10.

Referring once again to FIG. 3, it is noted that a U-shaped leaf spring 130 is mounted on the bottom portion of the back wall 77, below the lever 96. Two mounting tabs 132 and 134 formed on the bottom leg 136 of the leaf spring 130 extend through respective openings 138 and 140 of the back wall 77 and downwardly therefrom to secure the bottom leg thereon. An upwardly turned tab 142 (FIG. 5) formed at an intermediate portion of the upper leg 144 of the leaf spring 130 extends through a square opening 146 in the back wall 77. The upper edge 148 of the opening 146 serves as a stop for the tab 142 and the associated upper leg 144. A convex bend 150 is formed on the distal end of the upper leg 144 for cooperation with each of two spaced recessed portions 152 and 154 formed on the bottom edge 114 of the lever 96.

An actuator lug 156 is formed on the upper end of the mounting arm 46, extending across the space above the groove 110 in the top edge 108 of the lever 96 when the latter is in its rightmost or locked mode position, as viewed in FIG. 3. If the handle 22 were pulled or pivoted outwardly from the housing 20 while the lever 96 is in this locked mode position, the actuator lug 156 would merely move through the space above the groove 110, without moving the lever 96, and, therefore, without unlatching the latch 128.

In operation, once a key is inserted in the key cylinder 26 and rotated clockwise (FIG. 1) approximately a one-eighth turn, the lower body portion 84 of the key cylinder lever 82 similarly rotated to thereby cause the pin 122 in the open-ended slot 94 to move laterally with the arm 90 and finger 92 and, hence, to move the lever 96 to its leftmost or unlocked mode position (FIG. 4) as permitted by the movement of the pin 98 in the slot 102 in the lever 96. This brings the bent-over lip 106 into position just below the actuator lug 156.

While in the position just described, when the handle 22 is pulled outwardly, the actuator lug 156 engages the bent-over lip 106, urging it and its associated lever 96 in a counterclockwise rotation about the pin 98 (FIG. 5), against the force of the upper leg 144 of the spring 130, which has its convex bend 150 seated in the recessed portion 154 on the bottom edge 114 of the lever 96.

The result of the counterclockwise movement of the lever 96 is to move the pin 122 downwardly in the open-ended slot 94 between the arm 90 and the finger 92 of the key cylinder lever 82, and the end 116 of the lever 96 upwardly, causing the latch rod 124 to be lifted, to thereby raise the latch lever 128 (FIG. 2) and unlatch the latch mechanism 129 (FIG. 1) for opening the tailgate 10.

When the tailgate 10 is once again closed, and the handle 22 released, rotation of the key counterclockwise (FIG. 1) in the key cylinder 26 approximately a one-eighth turn moves the lever 96 to the right or locked mode in FIG. 3 via the corresponding action of the key cylinder lever 82, until the left end of the slot 92 engages the pin 98, to thereby render any lifting of the handle 22 ineffective, and retain the tailgate 10 in a locked condition.

At this point, the convex bend 150 of the leaf spring 130 seats in the recessed portion 152 on the bottom edge 114 of the lever 96. It should be noted that when the convex bend 150 of the leaf spring 130 is seated in either of the recessed portions 152 or 154, a positive stop is thereby provided which prevents the main lever 96 from being accidentally jarred from one of the locked or unlocked mode to the other by any lateral load against the vehicle.

Referring now to FIGS. 3, 4 and 8, the key cylinder lever 82 is shown to include an arcuate-shaped slot 158 concentric with the extension 88 of the key cylinder 26. The key cylinder lever 82 and, hence, the slot 158 pivots about a fixed tab 160 on the back of the key cylinder 26 from the left end (FIG. 3) of the slot 158 to a central point (FIG. 4) along the slot as the main lever 96 moves laterally from the locked to the unlocked modes. At assembly of the handle assembly 14, the key cylinder lever 82 is rotated such that the tab 160 is positioned in the extreme right end (FIG. 8) of the slot 158. In this position, the small diameter portion 162 of the pin 122 is slipped through the opening 164 between the distal end 166 of the finger 92 and the lower body portion 84, into the open end of the open-ended slot 94, and the lever 82 is then rotated clockwise to position the fixed tab 160 for its two operational positions (FIGS. 3 and 4), and retain the pin 122 in its operative position in the open-ended slot 94.

As an optional arrangement, a power actuator 170 (FIG. 2) may be mounted intermediate the outer and inner walls of the tailgate 10, and connected to the lever 96 adjacent the end 120 of the latter. Specifically, a connector rod 172 is connected between an opening 174 formed in the end 120 and 176 of a piston 178 reciprocally mounted in the actuator 160. An electrical connection 180 mounted on the bottom surface of the actuator 170 is adapted to receive a connector 182 of a lead line 184 extending from power door locks (not shown). The power actuator 170 may be included in addition to key cylinder 26 to slidably move the lever 96 between the locked and the unlocked positions while the operator is inside the vehicle.

If desired, an electrical connection, represented as 186 in FIG. 1, is mounted on the latch mechanism 129 and operatively connected to an indicator within the vehicle to indicate to the operator whether the tailgate is open or closed.

Additionally, if desired, a security alarm switch 188 may be mounted on the back of the key cylinder 26 (FIG. 9). The switch is operatively connected to an alarm (not shown) and adapted to sound the alarm in the event an attempt is made to punch out the key cylinder.

INDUSTRIAL APPLICABILITY

It should be apparent that the invention provides an efficient, compact liftgate housing assembly, containing both the pull-to handle and the key cylinder mounted as high as possible on the tailgate, away from any splashing contaminants from the roadway.

It should also be apparent that the invention provides a liftgate handle assembly including a handle, a key cylinder, and a main lever which is slidably moved between a locked mode and an unlocked mode by rotation of the key cylinder, and which is pivoted by movement of the handle to actuate a remote mounted tailgate latch.

While but one embodiment of the invention has been shown and described, other modifications thereof are possible within the scope of the following claims.

What is claimed is:

1. A tailgate handle assembly for actuating a remotely mounted latch, said tailgate handle assembly comprising a housing including a handle outwardly pivotally mounted therein, a key cylinder rotatably mounted therein, a lever slidably and pivotally mounted thereon and operably connected to said handle and said key cylinder, and a latch rod connected between said lever and said latch, said lever adapted to being reciprocally slidably actuated between a locked and an unlocked mode by rotation of said key cylinder and downwardly pivotally actuated by manual outward lifting of said handle to move said latch rod to thereby operate said latch.

2. A tailgate handle assembly spaced apart from a tailgate latch, said handle assembly comprising a housing having a central pocket formed therein, a handle flush mounted in the housing and adapted to being pivotally lifted outward from a key cylinder rotatably mounted in the housing adjacent said pocket, a main lever horizontally slidably and pivotally mounted in the housing to the rear of said pocket, a key cylinder lever secured to said key cylinder and pivotally connected to said main lever to horizontally slide same between locked and unlocked modes upon rotation of said key cylinder, an actuator lug formed on said handle adapted to abut against and pivot said main lever when in the unlocked mode upon the manual pivotal lifting of said handle, and a latch rod connected between one end of said main lever and said spaced apart tailgate latch.

3. The tailgate handle assembly described in claim 2, and a pair of spaced mounting arms formed in said housing, a pivot pin laterally secured between said pair of arms, a pair of spaced mounting extensions formed on said handle and pivotally connected to said pivot pin, a coil spring mounted around said pivot pin with one end thereof mounted on said housing and the other end thereof mounted on one of said pair of extensions and adapted to urge said handle into a closed flush condition in said housing.

4. The tailgate handle assembly described in claim 2, and a rearward extension on said key cylinder, wherein said key cylinder lever includes a lower body portion secured to said rearward extension for rotation therewith, an arm extending upwardly from said lower body portion, a finger extending downwardly from the upper end of said arm, said arm and said finger forming an open slot therebetween, and a pin secured adjacent the second end of said main lever and slidably mounted in said slot to accommodate lateral and vertical movement of said main lever.

5. The tailgate handle assembly described in claim 2, and a U-shaped leaf spring having one leg thereof secured to said housing, and a second leg thereof abutted against an edge of said main lever for urging said main lever into a horizontal orientation upon the release of said handle.

6. The tailgate handle assembly described in claim 5, and a pair of spaced apart recesses formed in a lower edge of said main lever, and a bend formed on the distal end of said second leg for alternately seating in said recesses during the locked and unlocked modes of said main lever.

7. The tailgate handle assembly described in claim 4, and an arcuate shaped slot formed in said lower body portion, a tab formed on said key cylinder adjacent said rearward extension and extended through said arcuate shaped slot and positioned at one end of said arcuate shaped slot when the main lever is in its locked mode, and positioned at the center of said arcuate shaped slot when the main lever is in its unlocked mode, and adapted to be positioned at the other end of said arcuate shaped slot only at the assembly of said main lever on said housing to accommodate the entry of said pin between the distal end of said finger and said lower body portion into said slot between said arm and said finger.

8. The tailgate handle assembly described in claim 5, and a stop formed on said housing for retaining said main lever in its horizontal orientation under the force of said second leg of said U-shaped leaf spring.

9. The tailgate handle assembly described in claim 2, and a second pocket formed behind said handle and fitted into said central pocket in said housing.

10. The tailgate handle assembly described in claim 2, and connector means formed on the second end of said main lever adjacent said pin adapted to receive a power actuator for laterally moving said main lever in lieu of manually rotating said key cylinder.

11. The tailgate handle assembly described in claim 2, and a security alarm switch mounted on the back of said key cylinder.

* * * * *